US009650803B1

(12) United States Patent
Bartels et al.

(10) Patent No.: US 9,650,803 B1
(45) Date of Patent: May 16, 2017

(54) TUBULAR INSERT FOR EXCAVATED HOLE WITH SAFETY COVER

(71) Applicants: Darren Bartels, Ancaster (CA); Dan Bartels, Hamilton (CA)

(72) Inventors: Darren Bartels, Ancaster (CA); Dan Bartels, Hamilton (CA)

( * ) Notice: Subject to any disclaimer, the term of this patent is extended or adjusted under 35 U.S.C. 154(b) by 0 days.

(21) Appl. No.: 15/140,263

(22) Filed: Apr. 27, 2016

(51) Int. Cl.
*E04H 12/22* (2006.01)
*E02D 27/42* (2006.01)

(52) U.S. Cl.
CPC ..... *E04H 12/2292* (2013.01); *E02D 27/42* (2013.01)

(58) Field of Classification Search
CPC ..... E04H 12/2292; E04D 27/42; E02D 27/42
See application file for complete search history.

(56) References Cited

U.S. PATENT DOCUMENTS 5,752,349 A * 5/1998 Fitzsimmons ..... A63B 71/023 248/156
5,819,468 A * 10/1998 Jollie ..... A01G 13/10 47/30
7,966,772 B2 * 6/2011 Bartels ..... E02D 17/04 52/169.13
8,887,452 B2 * 11/2014 Carhart ..... E04H 12/2292 52/169.13
9,140,016 B2 * 9/2015 Habodasz ..... E04F 13/0736
2007/0295421 A1 * 12/2007 Bartels ..... E02D 17/04 138/89
2008/0072510 A1 * 3/2008 Wells ..... E04C 3/34 52/251
2013/0116818 A1 * 5/2013 Hamilton ..... A61J 7/04 700/236
2015/0313095 A1 * 11/2015 Fenner, Jr. ..... A01G 7/045 47/84

* cited by examiner

*Primary Examiner* — Andrew J Triggs
(74) *Attorney, Agent, or Firm* — Steven M. Greenberg; CRGO Law

(57) ABSTRACT

A tubular insert sleeve system comprises a tubular insert sleeve for insertion into an excavated hole and a snug fitting and removable safety cover adapted to extend over the upper end of the tubular insert sleeve in order to cover the excavated hole. One or more sleeve fastening apertures are defined through the tubular insert sleeve adjacent the upper end thereof, and are adapted to receive one or more vermiform fasteners for fastening the safety cover to the tubular insert sleeve. Preferably, the sleeve fastening apertures are in the form of handles. In some embodiments, one or more cover fastening apertures are defined through the safety cover and the cover fastening aperture(s) cooperate with the sleeve fastening aperture(s) to receive the vermiform fastener(s) to fasten the safety cover to the tubular insert sleeve.

5 Claims, 8 Drawing Sheets

TUBULAR INSERT FOR EXCAVATED HOLE WITH SAFETY COVER

TECHNICAL FIELD

The present disclosure relates to a tubular insert sleeve for use with excavated holes of the kind which are dug to receive elongated objects such as utility poles, and more particularly to a combination of the tubular insert sleeve with a safety cover to discourage tampering and mitigate the circumstances in which anything may accidentally fall into the hole.

BACKGROUND

It is quite common for a commercial excavator to dig a series of spaced holes for receiving a number of respective elongated objects, such as utility poles. The excavation of the holes may take place before the utility poles can be located into the holes and therefore the holes may be left in a condition to receive the poles for a day or more. Because this is not safe, the holes are usually covered over by any convenient cover such as a board or pallet and the public danger may be signaled by a warning pylon placed over the board.

An improvement over such an improvised safety cover is to provide a tubular insert sized to fit the diameter of the hole and to place the insert into the hole. A protective cap having an internal diameter which is sized to fit over the external diameter of the insert is used to seal off the hole. The insert has the advantage of retaining surrounding soil and dirt so that it does not collapse into the hole thereby preserving the hole so that it can receive a utility pole at a later time.

The insert is usually provided in lengths which are commensurate with the depth of the hole and may vary in lengths of several feet to ten feet or more. One problem which arises with such inserts is that they are preferably withdrawn from the surrounding hole in order to be reused at another job site. With deep holes, this becomes particularly difficult because the entire length of the insert must be withdrawn and if this is done after the utility pole has been installed, the tubular insert must be lifted the entire height of the utility pole as well. Another problem which arises is that the smooth tubular surface of the insert is difficult to grasp for removal. In addition, the diameter of such tubes must in some cases be quite large and storage for transportation takes up a lot of space.

U.S. Pat. No. 7,966,772 and Canadian Patent No. 2,547,084 teach a tubular insert sleeve system for an excavated hole in which the sleeve is made of cooperating segments which can easily be separated and which form a sleeve when assembled. In a preferred embodiment, the sleeve is made of two cooperating segments, each segment extending the full height of the sleeve so that the joint between segments extends longitudinally along the height of the assembled sleeve. The operatively upper end of the assembled sleeve has an outwardly extending portion of greater outer diameter than the outer diameter of the remainder of the sleeve. The upper end thereby defines an outwardly extending flange which is more easily grasped for removal of the sleeve from an excavated hole and which in use will rest on the ground to surround the excavated hole.

The tubular insert sleeve system taught by U.S. Pat. No. 7,966,772 and Canadian Patent No. 2,547,084 include a snug fitting and removable safety cover adapted to extend over the upper end of the tubular insert sleeve in order to cover the excavated hole. However, there remains a risk that a curious or mischievous school age child or adolescent could remove the cover and then climb or fall into the hole and become trapped therein.

SUMMARY

In one aspect, a tubular insert sleeve system, comprises a tubular insert sleeve for insertion into an excavated hole, and a snug fitting and removable safety cover adapted to extend over the upper end of the tubular insert sleeve in order to cover the excavated hole. The tubular insert sleeve comprises at least two longitudinally extending segments adapted to cooperate with each other to form the tubular insert sleeve. The tubular insert sleeve has a cylindrical main portion having a pre-determined first external diameter selected to fit in the excavated hole so that an exterior surface of the main portion retains walls of the excavated hole when the tubular insert sleeve is inserted therein. The main portion extends from a bottom end of the tubular insert sleeve adapted for insertion into the excavated hole toward an upper portion of the tubular insert sleeve adjacent an upper end of the tubular insert sleeve remote from the bottom end. The upper portion has a pre-determined second external diameter greater than the first external diameter and selected to be larger than the excavated hole, and the main portion is longitudinally substantially longer than the upper portion. There is a discontinuity between the first external diameter and the second external diameter so that the upper end of the sleeve defines an outwardly extending annular flange providing a bearing surface for removal of the tubular insert sleeve from the excavated hole. The tubular insert sleeve being open at the bottom end. At least one sleeve fastening aperture is defined through the tubular insert sleeve adjacent the upper end thereof and is adapted to receive at least one vermiform fastener for fastening the safety cover to the tubular insert sleeve.

In some embodiments, at least one cover fastening aperture is defined through the safety cover, and the at least one cover fastening aperture is adapted to receive the at least one vermiform fastener for fastening the safety cover to the tubular insert sleeve. In some particular embodiments, the at least one cover fastening aperture is disposed in a covering face of the safety cover, inwardly of an annular rim thereof.

In certain embodiments, the at least one cover fastening aperture comprises two opposed cover fastening apertures and the at least one sleeve fastening aperture comprises two opposed sleeve fastening apertures.

In some embodiments, the at least one sleeve fastening aperture is formed in the main portion of the tubular insert sleeve, inferiorly of the upper portion of the tubular insert sleeve.

In some embodiments, each sleeve fastening aperture forms a handle in the tubular insert sleeve for removal of the tubular insert sleeve from the excavated hole.

In another aspect, a tubular insert sleeve system comprises a tubular insert sleeve for insertion into an excavated hole and a snug fitting and removable safety cover adapted to extend over the upper end of the tubular insert sleeve in order to cover the excavated hole. At least one cover fastening aperture is defined through the safety cover and at least one sleeve fastening aperture is defined through the tubular insert sleeve adjacent the upper end thereof. The at least one cover fastening aperture and the at least one sleeve fastening aperture are adapted to receive at least one vermiform fastener for fastening the safety cover to the tubular insert sleeve.

In a further aspect, a tubular insert sleeve system, comprises a tubular insert sleeve for insertion into an excavated hole and a snug fitting and removable safety cover adapted to extend over the upper end of the tubular insert sleeve in order to cover the excavated hole. At least one pair of opposed sleeve fastening apertures is defined through the tubular insert sleeve adjacent the upper end thereof. The sleeve fastening apertures are adapted to receive at least one vermiform fastener for encircling the safety cover to thereby fasten the safety cover to the tubular insert sleeve.

BRIEF DESCRIPTION OF THE DRAWINGS

These and other features of will become more apparent from the following description in which reference is made to the appended drawings wherein.

DETAILED DESCRIPTION

Figure 1:
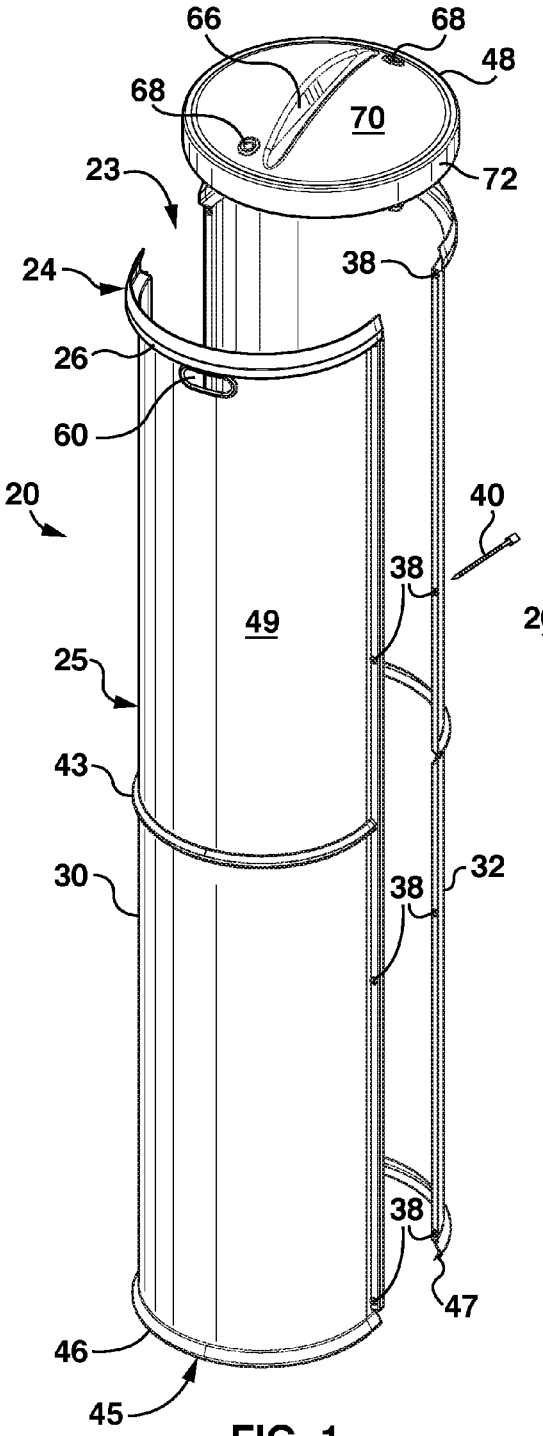
FIG. 1 is an exploded top front perspective view showing an assembled tubular insert sleeve and safety cover.
Figure 2:
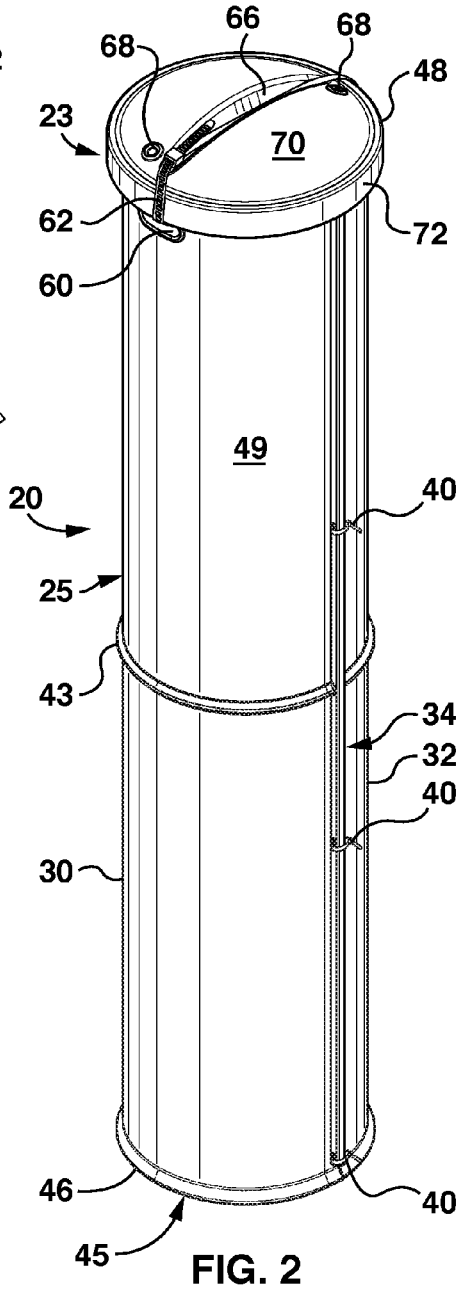
FIG. 2 is a top front perspective view of the assembled tubular insert sleeve and safety cover of FIG. 1.
Figure 3:
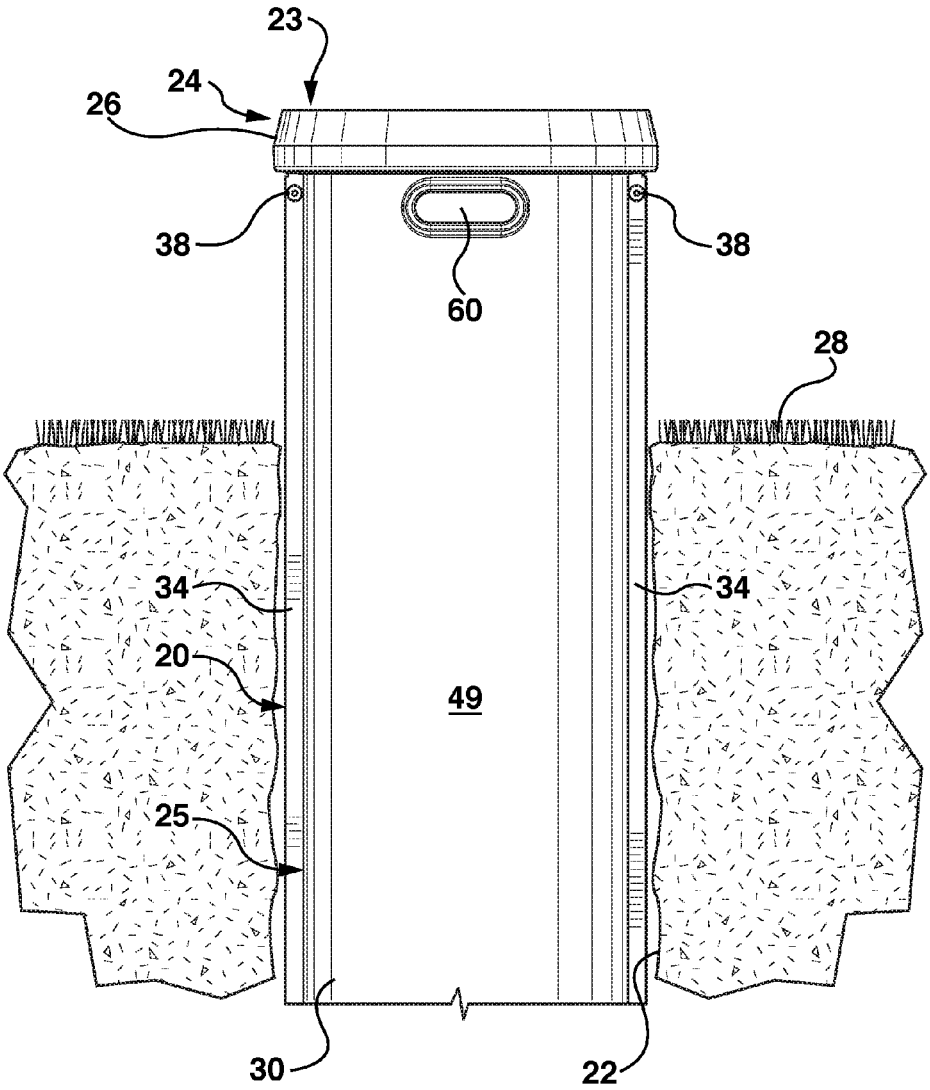
FIG. 3 shows an upper region of the assembled tubular sleeve of FIG. 1 in use inserted into an excavated hole.
Figure 4:
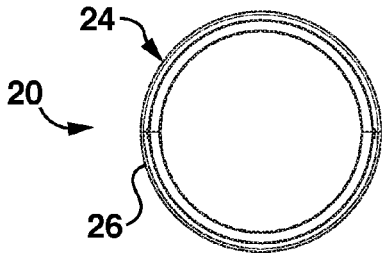
FIG. 4 is a top plan view of the tubular insert sleeve of FIG. 1 without the safety cover.
Figure 5:
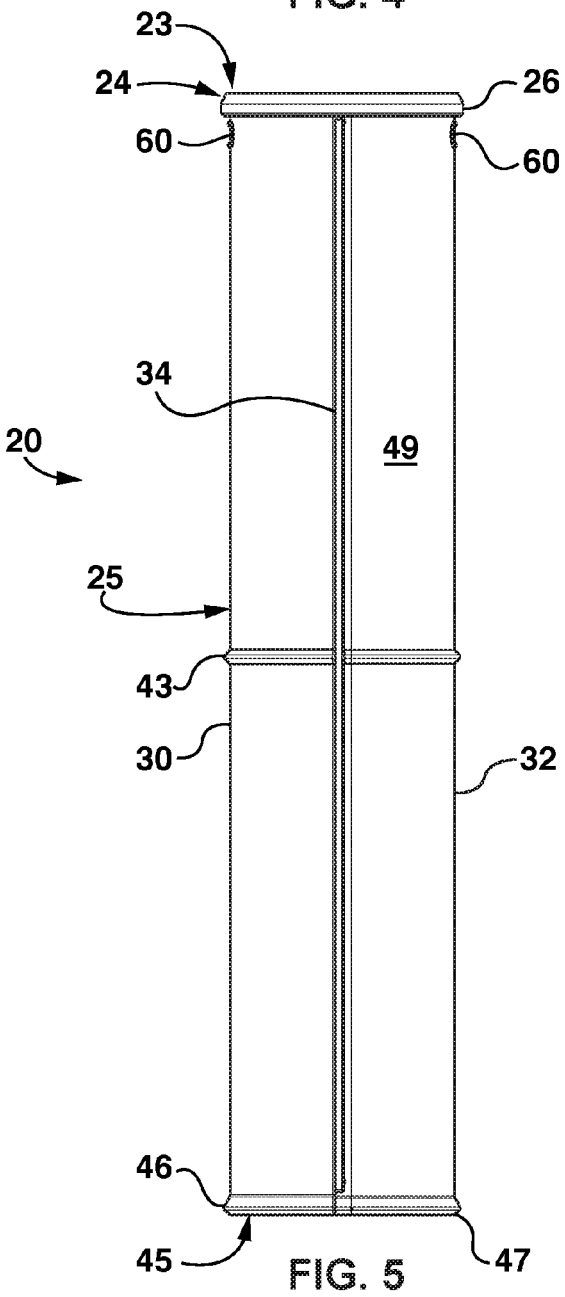
FIG. 5 is a first side elevation view of the tubular insert sleeve of FIG. 1 without the safety cover.
Figure 6:
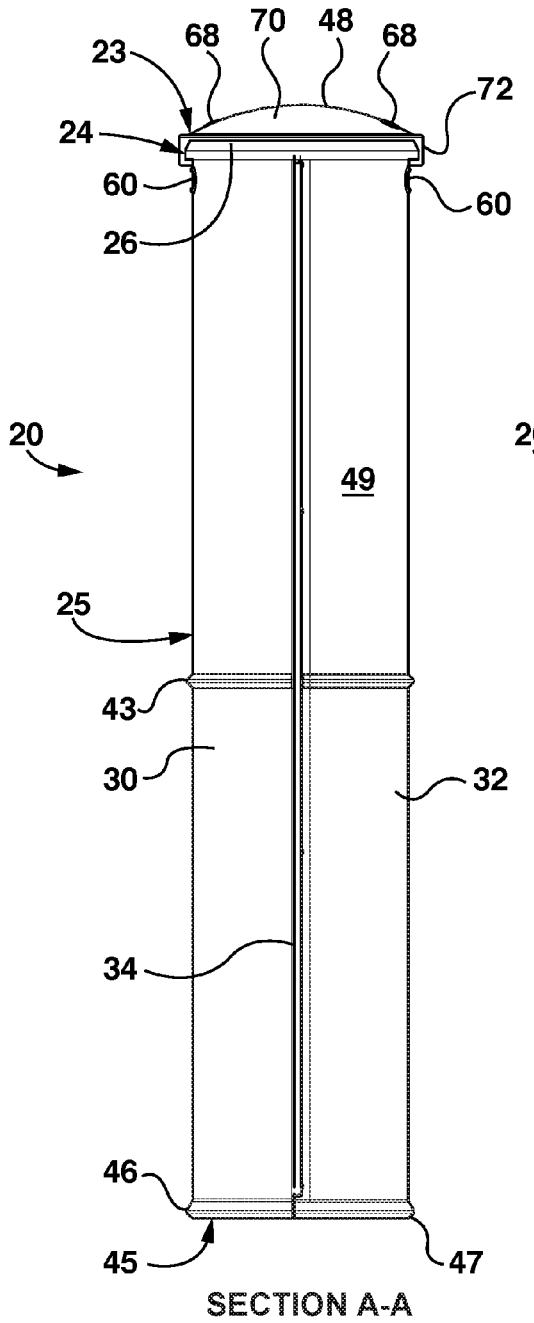
FIG. 6 is a cross-sectional view of the assembled tubular insert sleeve and safety cover of FIG. 1, taken along the line A-A in FIG. 7.
Figure 7:
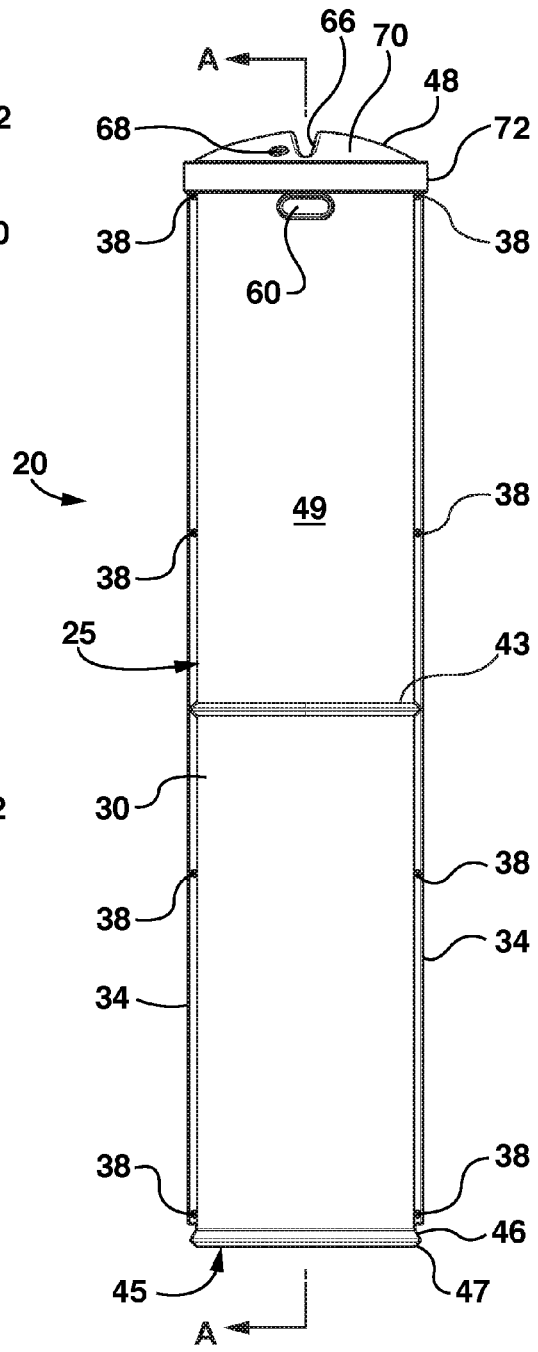
FIG. 7 is a first side elevation view of the assembled tubular insert sleeve and safety cover of FIG. 1.
Figure 8:
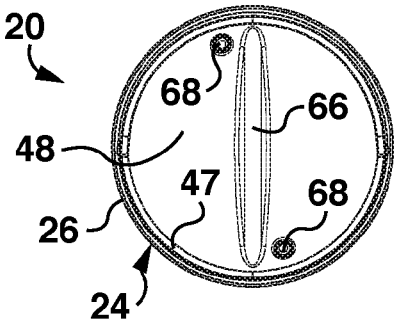
FIG. 8 is a bottom plan view of the assembled tubular insert sleeve and safety cover of FIG. 1.
Figure 9:
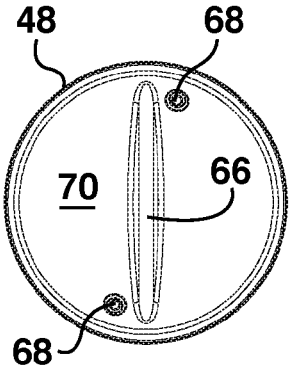
FIG. 9 is a top plan view of the assembled tubular insert sleeve and safety cover of FIG. 1.
Figure 10:
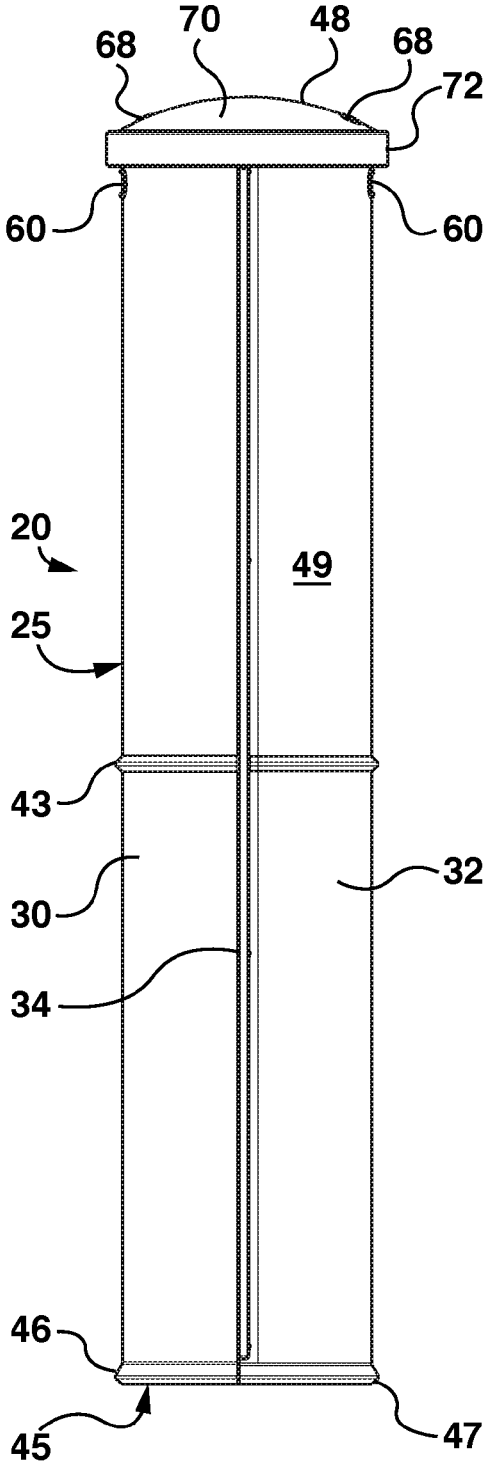
FIG. 10 is a second side elevation view of the assembled tubular insert sleeve and safety cover of FIG. 1.

An exemplary tubular insert sleeve is generally indicated in FIGS. 1 and 2 by reference numeral 20. In use, the tubular insert sleeve 20 will be inserted into an excavated hole 22 shown in FIG. 3. The tubular insert sleeve 20 comprises a cylindrical main portion 25 having a first pre-determined external diameter and extending from a bottom end 45 of the tubular insert sleeve 20 toward the operatively upper end 23 of the tubular insert sleeve 20. The upper end 23 of the tubular insert sleeve 20 has an outwardly extending upper portion 24 of greater outer diameter than the outer diameter of the main portion 25, which forms the remainder of the sleeve 20. Thus, the upper portion 24 has a pre-determined second external diameter that is greater than the first external diameter (i.e. of the main portion 25) and which is selected to be larger than the excavated hole 22, and there is a discontinuity between the first external diameter and the second external diameter. The upper portion 24 thereby defines an outwardly extending flange 26 which as shown in FIG. 3 will rest on or slightly above the ground 28 to surround the excavated hole 22. Because the upper portion 24 of the sleeve 20 is proud of the excavated hole 22 and the flange 26 provides a bearing surface, the tubular insert sleeve is more easily grasped for removal of the sleeve from the excavator hole 22. As can be seen in the drawings, the main portion 25 is longitudinally substantially longer than the upper portion 24.

Conveniently, the tubular insert sleeve 20 is made of a pair of cooperating segments 30, 32 which can easily be separated and which form the tubular insert sleeve 20 when assembled. In the embodiment illustrated, each segment 30, 32 extends the full height of the tubular insert sleeve 20 so that a pair of joints 34 (FIG. 2) between the segments 30, 32 extend longitudinally along the height of the assembled tubular insert sleeve 20 on opposite sides thereof.

Figure 11A:
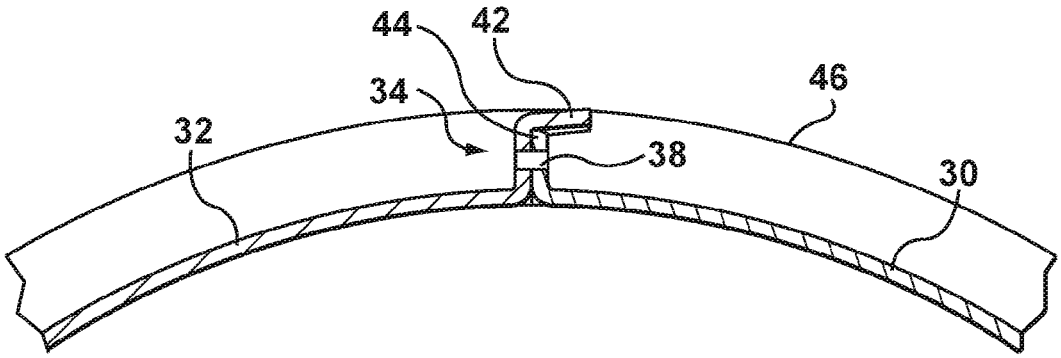
FIG. 11A is a cross-sectional schematic view showing details of a joint between two segments of the tubular insert sleeve of FIG. 1.
Figure 11B:
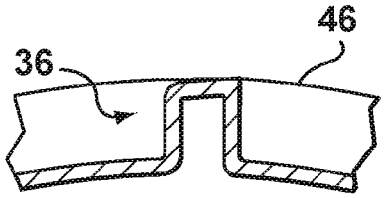
FIG. 11B is a cross-sectional schematic view showing a rib formed during moulding and which is cut to form the joint of FIG. 11A.

Conveniently, the entire tubular insert sleeve is rotation moulded from a single mould. During moulding, the joint 34 which is shown in more detail in FIG. 11A, is formed from an outwardly extending hollow rib 36 shown in FIG. 11B. After the moulding, the ribs 36 are drilled with vertically spaced apertures 38 along the height of the tubular insert sleeve 20 and the ribs 36 are subsequently cut to separate the respective segments 30, 32 forming the tubular insert sleeve 20. Thus, after cutting the ribs 36 there are two longitudinally extending segments 30, 32 adapted to cooperate with each other to form the tubular insert sleeve 20. The rib 36 is separated into an L-shaped section 42 which is integral with segment 32 and a straight wall section 44 which is integral with segment 30. In this way, the apertures 38 from both segments 30, 32 are aligned with each other. In order to secure the two segments 30, 32 together, a number of zip ties 40 (FIG. 2) corresponding in number to the apertures 38 are inserted through the apertures 38. Conveniently, during transportation, the segments 30, 32 may be separated from each other and transported in a nested configuration.

In order to improve the structural integrity of the tubular insert sleeve 20, the tubular insert sleeve 20 is provided with an outwardly extending hollow annulet 43 on the main portion 25, intermediate the upper end 23 and the bottom end 45. A similar hollow annulet 46 is formed at the bottom end 45 so that the tubular insert sleeve 20 has an inwardly directed annular flange 47 at the bottom end 45. The bottom end 45 is, aside from the annular flange 47, open and is adapted for insertion into an excavated hole 22 (FIG. 3).

In use, the tubular insert sleeve 20 is inserted into an excavated hole 22 as shown by FIG. 3. As can be seen, the outwardly extending upper portion 24 and about 20 to 28 inches of the main portion 25 immediately below the upper portion 24 remain above grade so as to reduce the likelihood of an individual stepping on the safety cover 48; the remainder of the main portion 25 is disposed in the hole 22. The cylindrical main portion 25 has a pre-determined first external diameter selected to fit in the excavated hole 22 so that an exterior surface 49 of the main portion 25 will act to retain the walls of the excavated hole 22 when the tubular insert sleeve 22 is inserted therein. The sleeve 20 then operates to maintain the integrity of the excavated hole 22 by retaining the surrounding dirt or material from which the hole has been excavated and preventing same from collapsing into the hole 22. The annulets 43, 46 and joints 34 protrude very little relative to the diameter of the main portion 25 and are not considered when assessing the diameter of the main portion 25.

In order to safeguard the public from accidentally falling into the hole or dropping objects into the hole, the upper portion 24 is covered with a safety cover 48 which is dimensioned to snap fit over the upper portion 24. Thus, the safety cover 48 is snug fitting and removable and is adapted to extend over the upper end 23 of the tubular insert sleeve 20 in order to cover the excavated hole 22. The choice of design for the safety cover 48 may vary considerably but it is intended that the safety cover 48 will fit snugly over the upper end 23 of the tubular insert sleeve 20 so that it is not easily removed. Preferably, the safety cover 48 and the upper end 23 of the tubular insert sleeve 20 are coloured a bright safety orange or green.

Figure 2A:
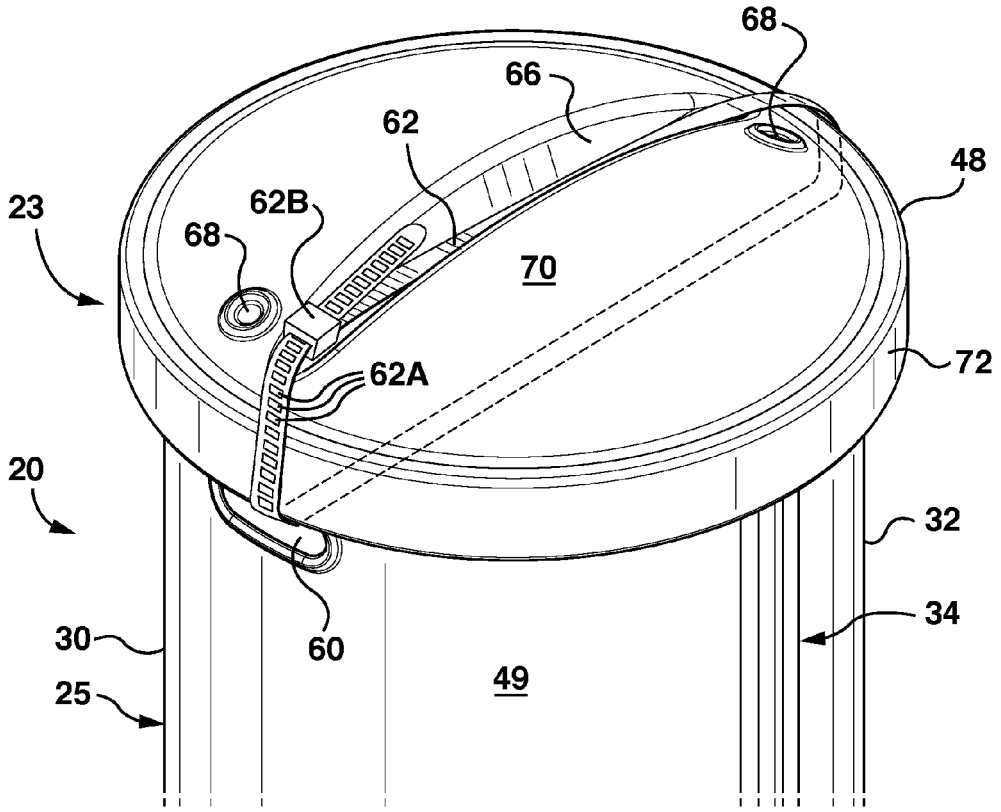
FIG. 2A is a detailed top front perspective view of an upper region of the assembled tubular insert sleeve and safety cover of FIG. 1 showing a first method for securing the safety cover to the tubular insert sleeve.

In order to inhibit unauthorized removal of the safety cover 48, the safety cover 48 is preferably fastened to the tubular insert sleeve 20 when the tubular insert sleeve 20 is disposed within the hole 22. To achieve this end, in the illustrated embodiment two opposed sleeve fastening apertures 60 are defined through the main portion of the tubular insert sleeve 20 adjacent to and inferiorly of the upper end 23 thereof. Each sleeve fastening aperture 60 forms a handle in the tubular insert sleeve 20 to assist in removal of the tubular insert sleeve 20 from the excavated hole 22, and each sleeve fastening aperture 60 is adapted to receive at least one vermiform fastener such as a zip tie (also referred to as a cable tie, tie strip or tie-wrap) 62 (FIG. 2A), 64 (FIG. 2B) for fastening the safety cover 48 to the tubular insert sleeve 20. As can be seen in FIG. 2A, a zip tie 62 comprises an elongate, flexible tape portion with teeth 62A that are engaged by a pawl in the head 62B to form a ratchet whereby as the tape portion is pulled through the head 62B in a tightening direction it will resist movement through the head 62B in the opposite (loosening) direction. Preferably, the zip ties 62, 64 for fastening the safety cover 48 to the tubular insert sleeve 20 are of the type which cannot be released but must be cut to be removed. For example, one-way nylon or steel zip ties may be used.

In one embodiment, as shown in FIG. 2A, a single large zip tie 62 may be threaded through the sleeve fastening apertures 60 to extend diametrically across the upper end 23 of the tubular insert sleeve 20 and then fastened over top of the safety cover 48, which may be provided with a channel 66 to receive the zip tie 62. Thus, in this embodiment the single large zip tie 62 encircles the safety cover 48 to thereby fasten the safety cover 48 to the tubular insert sleeve 20.

Figure 2B:
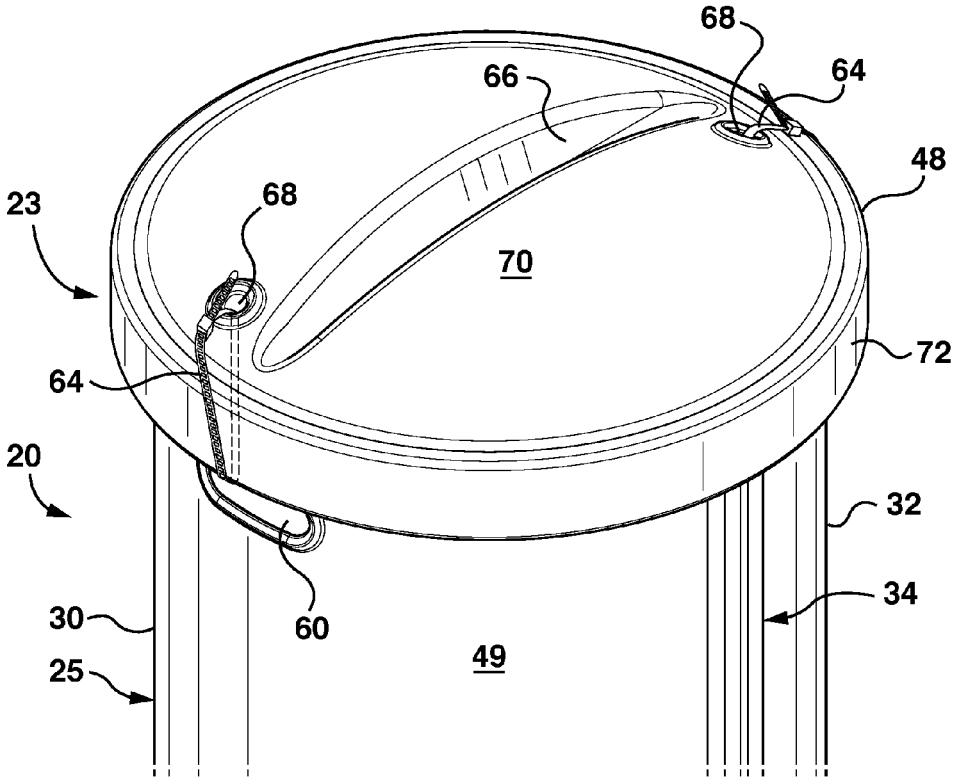
FIG. 2B is a detailed top front perspective view of an upper region of the assembled tubular insert sleeve and safety cover of FIG. 1 showing a second method for securing the safety cover to the tubular insert sleeve.

In another embodiment, as shown in FIG. 2B, two opposed cover fastening apertures 68 are defined through the safety cover 48; these cover fastening apertures 68 are also each adapted to receive a suitably sized zip tie 64 for fastening the safety cover 48 to the tubular insert sleeve 20. The cover fastening apertures 68 are disposed in a covering face 70 of the safety cover 48, inwardly of an annular rim 72 thereof. The safety cover 48 can be positioned so that the cover fastening apertures 68 are approximately aligned with the sleeve fastening apertures 60. Then, respective zip ties 64 can be threaded through the cover fastening apertures 68 and the sleeve fastening apertures 60 to encircle portions of the annular rim 72 of the safety cover 48 and thereby fasten the safety cover 48 to the tubular insert sleeve 20. While two opposed cover fastening apertures 68 and two opposed sleeve fastening apertures 60 are shown in the illustrated embodiment, in other embodiments there may be only a single cover fastening aperture and a single sleeve fastening aperture, or there may be three or more cover fastening apertures and sleeve fastening apertures. In addition, while sleeve fastening apertures which also function as handles are preferred, in other embodiments the sleeve fastening apertures need not take the form of handles.

Furthermore, while FIG. 2A shows the safety cover 48 with two opposed cover fastening apertures 68, it is to be appreciated that in embodiments in which a single large zip tie 62 is used as shown in FIG. 2A, the cover fastening apertures may be omitted. The channel 66, although preferred, is also optional.

When a utility pole or other elongated object is ready to be installed into the excavated hole 22, the tubular insert sleeve 20 may be removed from the hole 22. Depending on the nature of the ground surrounding the hole 22, it may be necessary to leave the tubular insert sleeve 20 in place when a utility pole or the like is installed in which case, the safety cover 48 is first removed. The upper portion 24 and/or sleeve fastening apertures 60 of the tubular insert sleeve 20 can then be grasped in order to raise the tubular insert sleeve 20 until it is withdrawn from the hole 22. As the tubular insert sleeve 20 progresses upwardly, access to the zip ties 40 allows a worker to sever the zip ties in order that the segments 30, 32 may be separated from each other. Thus, it is not necessary to withdraw the tubular insert sleeve 20 over the height of the utility pole or other object in order to withdraw the tubular insert sleeve 20 from the job site. Once removed, the segments 30, 32 are once again nested together in order to be transported to the next job site.

It will be understood that several variations may be made to the above described arrangements as will be apparent to those skilled in the art. In particular, the shape and configuration of the safety cover may vary as required. It will also be appreciated that other fasteners besides the zip ties 40 may be used to secure segments to each other and that the number of segments may also vary. In addition, the manner of forming a joint between segments may be changed in accordance with any design choice that is preferred. Furthermore, while zip ties are considered convenient for fastening the safety cover to the tubular insert sleeve, other types of fasteners, such as chains or cables with keyed or combination locks, may also be used. Finally, it will be appreciated that the tubular insert sleeve may be made in a variety of lengths and have a number of different diameters suited to the diameter of the intended excavation hole. For example, and without limitation, suitable diameters may include 16 inch and 24 inch diameters, among others. For some applications where the tubular insert sleeve is perhaps shorter in length, a grooved joint coupling whereby the cooperating segments will slide longitudinally relative to each other may be desirable. Alternatively, the segments may also be hinged relative to each other. Other such variations will be apparent to those skilled in the art.

One or more currently preferred embodiments have been described by way of example. It will be apparent to persons skilled in the art that a number of variations and modifications can be made without departing from the scope of the claims.

What is claimed is:

1. A tubular insert sleeve system, comprising:

a tubular insert sleeve for insertion into an excavated hole, the tubular insert sleeve comprising:

at least two longitudinally extending segments adapted to cooperate with each other to form the tubular insert sleeve;

the tubular insert sleeve having a cylindrical main portion having a pre-determined first external diameter selected to fit in the excavated hole so that an exterior surface of the main portion retains walls of the excavated hole when the tubular insert sleeve is inserted therein;

the main portion extending from a bottom end of the tubular insert sleeve adapted for insertion into the excavated hole toward an upper portion of the tubular insert sleeve adjacent an upper end of the tubular insert sleeve remote from the bottom end;

the upper portion having a pre-determined second external diameter greater than the first external diameter and selected to be larger than the excavated hole;

the main portion being longitudinally substantially longer than the upper portion;

there being a discontinuity between the first external diameter and the second external diameter so that the upper end of the sleeve defines an outwardly extending annular flange providing a bearing surface for removal of the tubular insert sleeve from the excavated hole;

the tubular insert sleeve being open at the bottom end; and a snug fitting and removable safety cover adapted to extend over the upper end of the tubular insert sleeve in order to cover the excavated hole;

further comprising:

at least one sleeve fastening aperture defined through the tubular insert sleeve adjacent the upper end thereof;

the at least one sleeve fastening aperture being adapted to receive at least one vermiform fastener for fastening the safety cover to the tubular insert sleeve;

at least one cover fastening aperture defined through the safety cover;

the at least one cover fastening aperture being adapted to receive the at least one vermiform fastener for fastening the safety cover to the tubular insert sleeve;

the at least one cover fastening aperture being disposed in a covering face of the safety cover, inwardly of an annular rim of the safety cover.

2. The tubular insert sleeve system of claim 1, wherein the at least one sleeve fastening aperture is formed in the main portion of the tubular insert sleeve, interiorly of the upper portion of the tubular insert sleeve.

3. The tubular insert sleeve system of claim 2, wherein the at least one sleeve fastening aperture comprises two opposed sleeve fastening apertures.

4. The tubular insert sleeve system of claim 1, wherein:

the at least one cover fastening aperture comprises two opposed cover fastening apertures; and the at least one sleeve fastening aperture comprises two opposed sleeve fastening apertures.

5. The tubular insert sleeve system of claim 1, wherein each sleeve fastening aperture forms a handle in the tubular insert sleeve for removal of the tubular insert sleeve from the excavated hole.

* * * * *